US012723833B2

(12) United States Patent
Lewin et al.

(10) Patent No.: US 12,723,833 B2
(45) Date of Patent: Sep. 1, 2026

(54) SELF-PROPELLED GUN SYSTEM

(71) Applicant: BAE SYSTEMS PLC, London (GB)

(72) Inventors: Richard Peter Lewin, Barrow-in-Furness (GB); Edward Elliott, Farnborough (GB)

(73) Assignee: BAE SYSTEMS PLC, London (GB)

( * ) Notice: Subject to any disclaimer, the term of this patent is extended or adjusted under 35 U.S.C. 154(b) by 113 days.

(21) Appl. No.: 18/868,317

(22) PCT Filed: May 16, 2023

(86) PCT No.: PCT/GB2023/051272
§ 371 (c)(1),
(2) Date: Nov. 22, 2024

(87) PCT Pub. No.: WO2023/227861
PCT Pub. Date: Nov. 30, 2023

(65) Prior Publication Data

US 2026/0185795 A1 Jul. 2, 2026

(30) Foreign Application Priority Data

May 27, 2022 (EP) ..... 22275069
May 27, 2022 (GB) ..... 2207844

(51) Int. Cl.
*F41A 23/34* (2006.01)

(52) U.S. Cl.
CPC ..... *F41A 23/34* (2013.01)

(58) Field of Classification Search
CPC ..... F41A 23/34; F41A 23/28; F41A 23/56; F41A 25/00; F41A 25/08; F41A 25/06;
(Continued)

(56) References Cited

U.S. PATENT DOCUMENTS 4,265,326 A * 5/1981 Lauber ..... E02F 9/04 180/8.3
4,353,284 A * 10/1982 Billottet ..... F41H 7/02 89/41.22

(Continued)

FOREIGN PATENT DOCUMENTS

GB 158 023 A 2/1921
GB 1438403 A 6/1976

(Continued)

OTHER PUBLICATIONS

International Search Report and Written Opinion received for PCT/GB2023/051272. Mail Date: Jul. 26, 2023. 8 pages.

(Continued)

*Primary Examiner* — Joshua E Freeman
(74) *Attorney, Agent, or Firm* — Arcane Law PLLC

(57) ABSTRACT

A self-propelled gun system defining a recoil mitigation system comprises a chassis; a gun barrel and a chassis suspension system comprising a first wheel arm extending away from the chassis to a first wheel, the first wheel being rotatably mounted on the first wheel arm, the first wheel configured for engagement with a support surface. The first wheel arm and first wheel are configured to support the chassis a distance (Dz) apart from the support surface. The recoil mitigation system is operable such that a maximum recoil damping distance (Dz_max) of the chassis from the support surface in the z-axis for a gun firing condition is controlled to be set according to a predetermined relationship by pivoting the first wheel arm relative to the z-axis.

17 Claims, 5 Drawing Sheets

(58) Field of Classification Search
CPC ..... F41A 25/12; F41A 25/22; F41A 25/24; F41A 25/26
See application file for complete search history.

(56) References Cited

U.S. PATENT DOCUMENTS

| | | | | | |
|---|---|---|---|---|---|
| 4,708,051 | A * | 11/1987 | Argon | F41F 1/06 D22/100 |
| 6,000,313 | A * | 12/1999 | Becker | F41A 23/34 89/40.02 |
| 6,702,050 | B1 * | 3/2004 | Mazhar | B62D 55/07 180/10 |
| 12,467,710 | B1 * | 11/2025 | Lewin | F41A 23/28 |
| 12,560,402 | B2 * | 2/2026 | Elliott | F41A 23/34 |
| 12,584,708 | B2 * | 3/2026 | Lewin | F41A 23/28 |
| 2015/0174979 | A1 * | 6/2015 | Raczek | F41A 23/34 89/43.01 |
| 2024/0410670 | A1 * | 12/2024 | Elliott | F41A 23/34 |
| 2025/0198721 | A1 * | 6/2025 | Lewin | F41A 23/28 |

FOREIGN PATENT DOCUMENTS

| | | | |
|---|---|---|---|
| JP | 2003-294392 | A2 | 10/2003 |
| WO | WO2023227861 | A1 | 11/2023 |

OTHER PUBLICATIONS

Extended European Search Report Received for EP Application No. 22275069.7, dated Nov. 10, 2022. 4 pages.
GB Search Report under Section 17(5) received for GB Application No. 2207844.8, dated Nov. 25, 2022. 4 pages.

* cited by examiner

SELF-PROPELLED GUN SYSTEM

FIELD

The present invention relates to a self propelled gun system.

In particular it relates to a self propelled gun system with integral recoil mitigation system.

BACKGROUND

When artillery systems fire, the gun generates very large recoil forces which must be managed and dissipated. Failing to dissipate the forces leads to the system moving in uncontrolled ways, making them hard to manage and/or dangerous. When firing at low angles the recoil loads may generate an overturning moment which may cause the weapon to jump or even overturn during the shot. Lightweight systems tend to be fixed to the ground e.g. via braked wheels/tracks or spades.

In such systems the recoil forces are managed by recoil systems and the forces can be reduced by increasing the length of the recoil stroke and/or increasing the recoiling mass as, via conservation of momentum, this reduces the recoil velocity and hence energy. However, these features all add weight, making it very hard to create a stable light weight system.

Conventionally, self-propelled gun systems (i.e. those which have a powertrain, but which are lighter than heavy weaponry such as tanks) have wheels, suspension, drive and braking systems needed for transit in addition to support systems which deal with the very large impulse directional loads experienced during operation of the gun. This adds to extra weight and complexity, making it harder to achieve a desired weight limit.

Hence a self propelled gun system which is relatively lightweight and yet stable when absorbing recoil forces is highly desirable.

SUMMARY

According to the present disclosure there is provided an apparatus and system as set forth in the appended claims. Other features of the invention will be apparent from the dependent claims, and the description which follows.

Accordingly there may be provided a self-propelled gun system (10) defining a recoil mitigation system (100). The self-propelled gun system (10) may comprise a chassis (200) extending along an x-axis, a first end (202) of the chassis (200) and a second end (204) of the chassis (200) spaced apart from one another along the x-axis; the chassis (200) extending along a y-axis, a first side (206) of the chassis (200) and a second side (208) of the chassis (200) spaced apart from one another along the y-axis; the x-axis being at right angles to the y-axis. The self-propelled gun system (10) may further comprise a gun barrel (300) having a barrel axis (302), the barrel (300) being mounted to the chassis (200) by a pivot mount (304), the barrel (300) being pivotable relative to the x-axis about a pivot axis (310) aligned and/or parallel with the y-axis. The self-propelled gun system (10) may further comprise a chassis suspension system (400) comprising a first wheel arm (402) extending away from the chassis (200) to a first wheel (404), the first wheel (404) being rotatably mounted on the first wheel arm (402), the first wheel (404) configured for engagement with a support surface (500), the first wheel arm (402) and first wheel (404) configured to support the chassis (200) a distance (Dz) apart from the support surface (500) in a z-axis, the z-axis being perpendicular to the x-axis and y-axis.

The recoil mitigation system (100) may beoperable such that a maximum recoil damping distance (Dz_max) of the chassis (200) from the support surface (500) in the z-axis is variable to thereby vary the available damping distance in the z-axis to absorb recoil force (Fr) from the firing of a projectile (340) from the gun barrel (300)

The self-propelled gun system (10) may further comprise a first wheel brake control device (600) configured for applying a braking force to the rotatable first wheel (404) in response to movement of the chassis (200) in the x-axis by a recoil force (Fr) from the firing of a projectile (340) from the gun barrel (300).

The brake control device (600) may be configured for applying the braking force to the rotatable first wheel (404) after the firing of a projectile (340) from the gun barrel (300) and after the rotatable first wheel (404) has started rotating along the support surface (500) in response to the firing of a projectile (340) from the gun barrel (300).

The brake control device (600) may be configured to gradually and/or intermittently apply the braking force to the rotatable first wheel (404) after the rotatable first wheel (404) has started rotating.

The brake control device (600) may be a regenerative braking device (602), and the regenerative braking device (602) is operably linked with a rechargeable electric storage device (700) and the at least one first wheel (404) for generating an electrical current by decelerating the at least one first wheel (404) and dissipating the recoil of the self-propelled gun system (10).

The self-propelled gun system (10) may further comprise a processor (610) in communication with the regenerative braking device (602) and to the rechargeable electric storage device (700) such that in response to a first movement of the chassis (200) along the support surface (500), the processor (610) causes the regenerative braking device (602) to decelerate the first wheel (404).

The gun barrel (300) may be constrained to pivot about the pivot axis (310) in a plane of movement extending through the x-axis and z-axis and/or is constrained to pivot about the pivot axis (310) between −5 degrees to the x-axis and +75 degrees to the x-axis.

The gun barrel (300) may be rotatable about the z-axis, limited to be rotatable no more than +/−5 degrees relative to a direction parallel to the x-axis around the z-axis.

The distance (Dy) of the first wheel (404) from the x-axis in a direction along the y-axis may be operable to be increased to thereby increase the stability of the chassis (200) along the x-axis and y-axis to maintain orientation of the chassis (200) during and after the firing of a projectile (340) from the gun barrel (300).

The maximum recoil damping distance (Dz_max) of the chassis (200) from the support surface (500) in the z-axis for a gun firing condition may be controlled to be set by pivoting the first wheel arm (402) relative to the z-axis, and a resilient suspension unit (420) is provided to bias the first wheel arm (402) to move the chassis (200) back to being spaced part from the support surface (500) by the set maximum recoil damping distance (Dz_max) after displacement of the chassis (200) away from the set maximum recoil damping distance (Dz_max).

The chassis first wheel arm (402) may extend away from the chassis (200) at an angle to the x-axis and the y-axis; and the resilient suspension unit (420) extends between the chassis (200) and the chassis first wheel arm (402).

The resilient suspension unit (420) may comprise at least one of air springs, switchable shock absorbers, hydropneumatic, hydrolastic and hydragas suspensions, wherein the resilient suspension unit (420) is configured to vary its spring stiffness.

The chassis suspension system (400) may further comprise a first leg strut (240), the first leg strut (240) pivotably attached to the chassis (200) at a coupling end (242), and extending to a foot (244) configured for engagement with the support surface (500) to support the chassis (200) apart from the support surface (500).

The unladen mass of the self-propelled gun system (10) may be no greater than 10 tonnes or no greater than 5 tonnes.

There may also be provided a method of operation of a self-propelled gun system (10) defining a recoil mitigation system (100), the self-propelled gun system (10) comprising: a chassis (200) extending along an x-axis, a first end (202) of the chassis (200) and a second end (204) of the chassis (200) spaced apart from one another along the x-axis; the chassis (200) extending along a y-axis, a first side (206) of the chassis (200) and a second side (208) of the chassis (200) spaced apart from one another along the y-axis; the x-axis being at right angles to the y-axis; a chassis suspension system (400) comprising a first wheel arm (402) extending away from the chassis (200) to a first wheel (404), the first wheel (404) being rotatably mounted on the first wheel arm (402), the first wheel (404) configured for engagement with a support surface (500), the first wheel arm (402) and first wheel (404) configured to support the chassis (200) a distance (Dz) apart from the support surface (500) in a z-axis, the z-axis being perpendicular to the x-axis and y-axis; the first wheel arm (402) being pivotable relative to the chassis (200), and a resilient suspension unit (420) is provided to bias the first wheel arm (402) to move the chassis (200) back to being spaced apart from the support surface (500) by a set maximum recoil damping distance (Dz_max) after displacement of the chassis (200) away from the set maximum recoil damping distance (Dz_max); and a first wheel (404) brake control device (600) configured for applying a braking force to the rotatable first wheel (404) in response to movement of the chassis (200) in the x-axis by a recoil force (Fr) from the firing of a projectile (340) from the gun barrel (300); and the method comprising the steps of, for each gun firing condition: pivoting the first wheel arm (402) relative to the chassis (200) to change the distance of the chassis (200) from the support surface (500) in the z-axis to the set maximum recoil damping distance (Dz_max) for the gun firing condition; wherein the set maximum recoil damping distance (Dz_max) of the chassis (200) from the support surface (500) for the gun firing position is set according to a predetermined relationship; and the brake control device (600) is controlled to apply the braking force to the rotatable first wheel (404) after the firing of a projectile (340) from the gun barrel (300).

The predetermined relationship may be a function of: a mass of a projectile (340) being fired from the gun barrel (300); the type and mass of charge provided to propel the projectile (340); and/or angle of the barrel axis (302) relative to the x-axis.

Hence there is provided a self propelled gun system which is relatively lightweight and yet stable, with a suspension system configured for transit and gun operation.

BRIEF DESCRIPTION OF THE FIGURES

Embodiments of the invention will now be described by way of example only with reference to the figures, in which.

DETAILED DESCRIPTION

Figure 10:
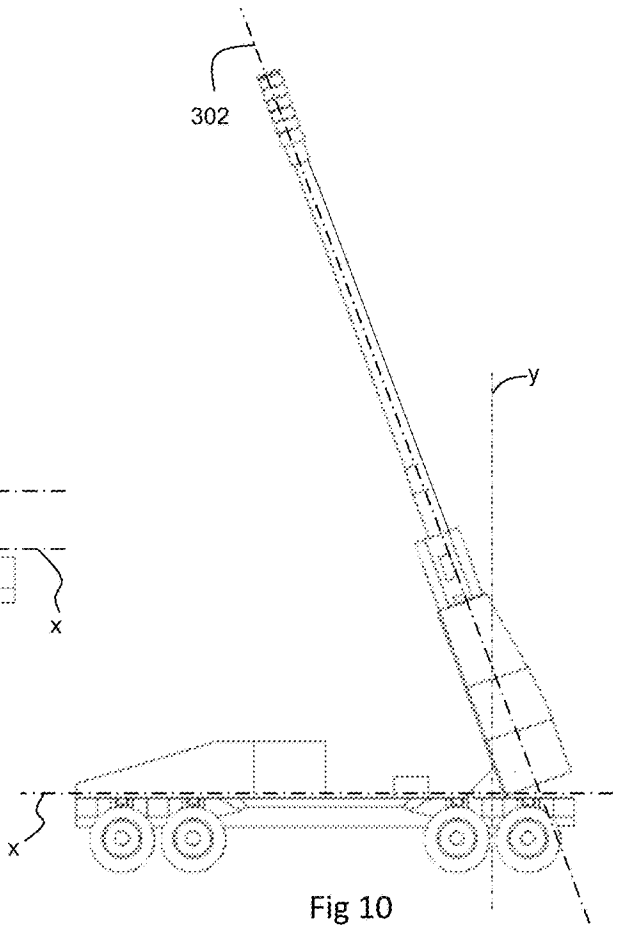

The present disclosure relates to a self-propelled gun system 10 having a recoil mitigation system 100. This is shown diagrammatically FIGS. 1 to 8. FIGS. 9, 10 show how such a device may look when reduced to practice.

The self-propelled gun system 10 may comprise a powertrain 800 such as an internal combustion engine, electric motor or hybrid, wherein the drive may be transferred by drive shafts to wheels 404, 1404. Other apparatus on the system 10 may be electrically powered. The wheels 404, 1404 are coupled to and driveable by the powertrain 800 to propel the gun system 10.

The unladen mass of the self-propelled gun system 10 may be no greater than 10 tonnes. The unladen mass of the self-propelled gun system 10 may be no greater than 5 tonnes. Hence there is provided a self-propelled gun system 10 which is considerably lighter than a tank, and hence easier to transport and requiring less raw materials to construct.

As illustrated in the figures, the self-propelled gun system 10 comprises a chassis 200 extending along an x-axis. A first end 202 of the chassis 200 and a second end 204 of the chassis 200 are spaced apart from one another along the length of the chassis 200 along the x-axis. The chassis 200 extends along a y-axis along the width of the chassis 200. A first side 206 of the chassis 200 and a second side 208 of the chassis 200 are spaced apart from one another across the width of the chassis 200 along the y-axis. The x-axis is at right angles to the y-axis.

As shown in FIGS. 1 to 4, the gun barrel 300 has a barrel axis 302, the barrel 300 being mounted to the chassis 200 by a pivot mount 304. The barrel 300 is pivotable relative to the x-axis about a pivot axis 310 aligned and/or parallel with the y-axis.

The barrel 300 may has a front end 320, with a muzzle 322 provided towards the front end 320. The barrel 300 has a rear end 324, with a breech assembly 326 provided at the rear end 324.

Figure 2:
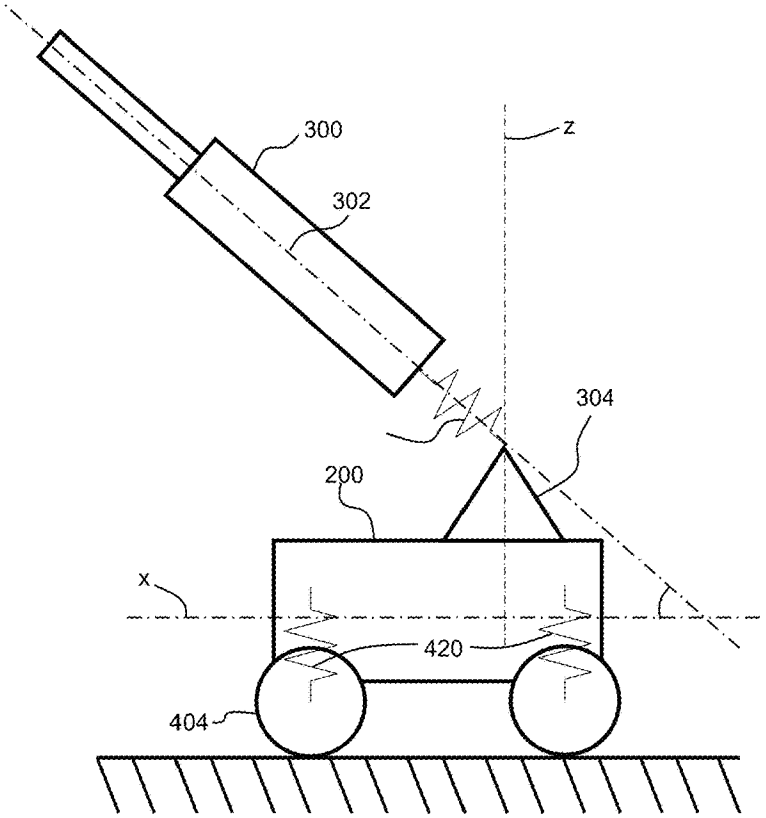
FIGS. 1, 2 show a diagrammatic side view of a self-propelled gun system according to the present disclosure in different gun firing conditions.
Figure 1:
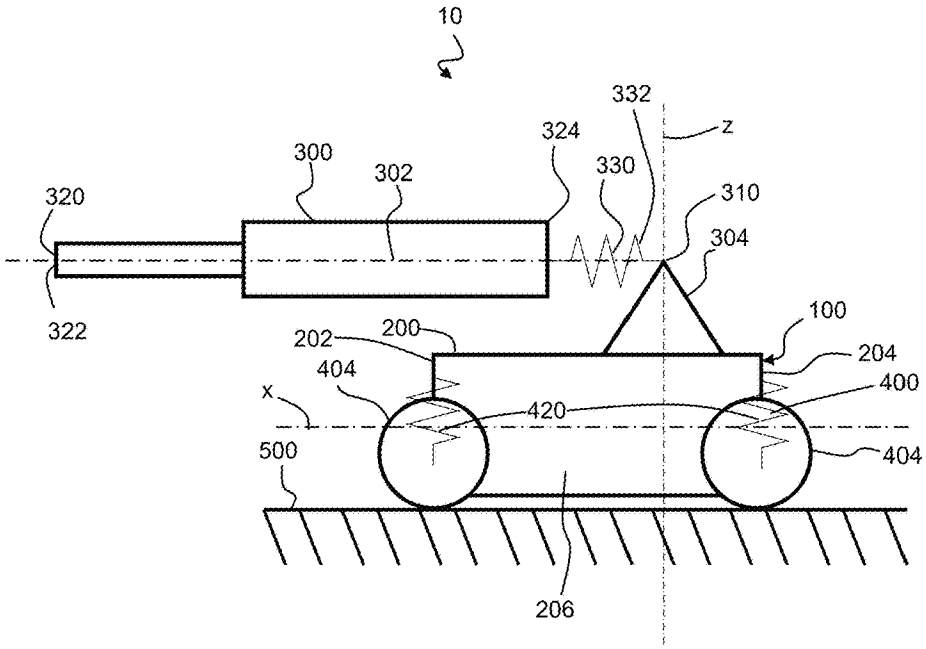

As shown in FIG. 1, the gun barrel 300 may be coupled to a recoil mechanism 330 comprising a recuperator 332 for mitigating a recoil force Fr along the barrel axis 302 from the firing of a projectile 340 from the gun barrel 300.

Figure 5:
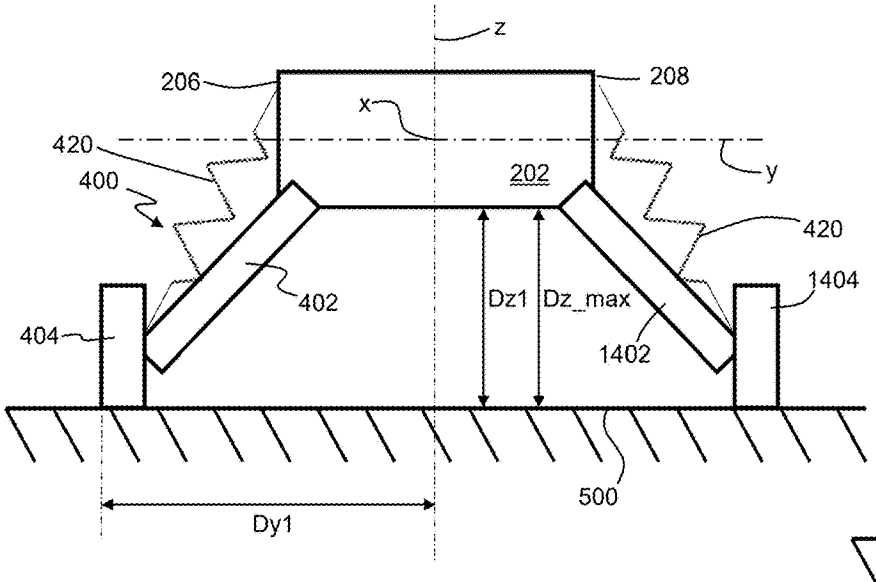
FIGS. 5, 6, 7 illustrate different states of the suspension system which forms part of the recoil mitigation system of the present disclosure.
Figure 6:
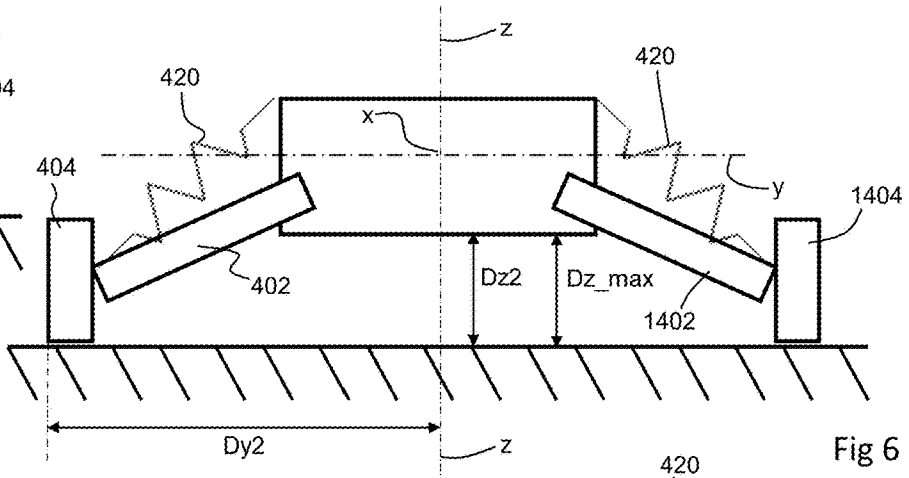
Figure 7:
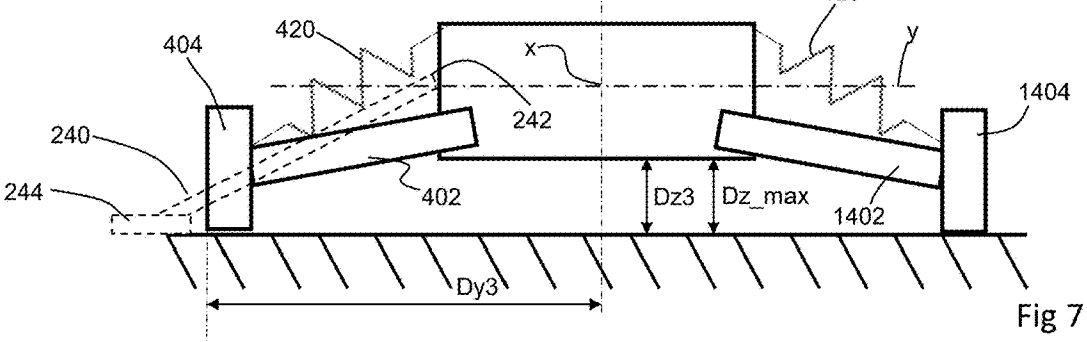

As shown in the end views of FIGS. 5 to 7, the self-propelled gun system 10 further includes a chassis suspension system 400 comprising a first wheel arm 402 extending away from the chassis 200 to a first wheel 404. The chassis first wheel arm 402 may extend away from the chassis 200 towards a support surface 500 (e.g. the ground) at an angle to the x-axis, y-axis and/or z-axis. The first wheel 404 is rotatably mounted on the first wheel arm 402.

The self-propelled gun system 10 may further comprise a second wheel arm 1402 configured, mounted and operable as the first wheel arm 402. As with the first wheel arm 402, the second wheel arm 1402 extends away from the chassis 200, towards the support surface 500 (e.g. the ground) at an angle to the x-axis, y-axis and/or z-axis, to a second wheel 1404. The second wheel 1404 is rotatably mounted on the second wheel arm 1402.

The second wheel arm 1402 is configured to operate in the same way as the first wheel arm 402. Hence features and operation of the first wheel arm 402 herein described are equally applicable to the second wheel arm 1402, even where the second arm 1402 is not specifically referenced.

As shown in FIGS. 5 to 7, the first wheel 404 is configured for engagement with the support surface 500 (e.g. the ground). Hence the first wheel arm 402 and first wheel 404 are configured to support the chassis 200 a distance Dz apart from the support surface 500 in the z-axis, the z-axis being perpendicular to the x-axis and y-axis. Likewise, the second wheel 1404 is configured for engagement with the support surface 500, the second wheel arm 1402 and second wheel 1404 configured to support the chassis 200 the distance Dz apart from the support surface 500 in the z-axis.

Hence the second wheel arm 1402 and second wheel 1404 are configured to support the chassis 200 together with the first wheel arm 402 and first wheel 404 the distance (Dz) apart from the support surface 500 in a z-axis.

The first wheel arm 402 and second wheel arm 1402 extend away from each other on opposite sides of the chassis 200. That is to say the first wheel arm 402 and second wheel arm 1402 are opposite each other across the x-axis. Put another way, the first wheel arm 402 extends away from the chassis 200 from the first side 206 of the chassis 200 and the second wheel arm 1402 extends away from the chassis 200 from the second side 208 of the chassis 200.

Hence the wheel arm 402 and the second wheel arm 1402 form a pair of wheel arms 402, 1402 which are attached a pair of wheels 404, 1404. As shown in FIGS. 1, 2, 3, 8, 9 and 10, the gun system 10 may comprise further pairs of wheel arms 402, 1402 and wheels for 404, 1404.

Hence, in such examples, the or each pair of wheel arms 402, 1402 work together to support the chassis 200 the distance Dz apart from the support surface 500 in a z-axis.

In some examples, a single wheel arm 402 and wheel 404 may be provided in isolation (i.e. without a corresponding second wheel arm 1402 and second wheel 1404), for example where the self-propelled vehicle has only three wheels, two of which form a pair opposite one another across the x-axis, and the third being spaced apart from the others along the x-axis.

As shown in FIG. 7, the chassis suspension system 400 may further comprise a first leg strut 240, the first leg strut 240 pivotably attached to a side 206, 208 of the chassis 200 at a coupling end 242, and extending to a foot 244 configured for engagement with the support surface 500 to support the chassis 200 apart from the support surface 500. A second leg strut 204 may be provided which is attached to, and extends away from, the second side 208 of the chassis 200. Such pairs of leg struts may be provided along the length of the chassis 200. The leg strut(s) are configured to provide additional stability in addition to the wheel arms 402, 1402 and wheels 404, 1404.

The chassis suspension system 400 forms at least part of the recoil mitigation system 100 and is configured such that the recoil mitigation system 100 is operable such that a maximum recoil damping distance Dz_max of the chassis 200 from the support surface 500 in the z-axis for a gun firing condition is variable to thereby vary the available damping distance (Dz) in the z-axis to absorb recoil force (Fr) from the firing of a projectile 340 from the gun barrel 300. Hence the moveable distance (distance Dz) by the chassis 200 relative to the support surface 500 (i.e. the damping distance), or resistance to motion, to provide recoil mitigation (i.e. damping) may be adjusted by pivoting the first wheel arm 402 (and/or second wheel arm 1402) relative to the chassis 200 to change the distance Dz the chassis 200 can/will move relative to the support surface 500 in the z-axis to the set maximum recoil damping distance (Dz_max) for the gun firing condition.

A resilient suspension unit 420 is provided to bias the first wheel arm 402. Likewise, in examples in which the second wheel arm 1402 is present, a resilient suspension unit 1420 may be provided to bias the second wheel arm 1402. The resilient suspension unit 420 may extend between the chassis 200 and the chassis first wheel arm 402. The resilient suspension unit 1420 may extend between the chassis 200 and the chassis second wheel arm 1402. The resilient suspension units 420, 1420 are provided to bias the first wheel arm 402 and second wheel arm 1420 to move the chassis 200 back to being spaced part from the support surface 500 by the set maximum recoil damping distance Dz_max after displacement of the chassis 200 away from the set maximum recoil damping distance Dz_max. For example, the displacement may be in response to a recoil force Fr from the firing of a projectile 340 from the gun barrel 300.

As the angle of the barrel axis 302 relative to the x-axis is varied (for example, as shown in FIGS. 1 to 4, 9, 10) the set maximum recoil damping distance Dz_max (i.e. available for absorbing recoil movement) of the chassis 200 from the support surface 500 in the z-axis may be varied (as shown in FIGS. 5, 6, 7). Hence the chassis suspension system 400 is operable to vary the damping distance and/or damping resistance by pivoting the wheel arms 402, 1402 relative to the chassis 200 to raise and lower the chassis 200 to accommodate change in direction of recoil forces because of the angle of the barrel axis 302.

As the angle of the barrel axis 302 relative to the x-axis is increased, the maximum recoil damping distance Dz_max of the chassis 200 from the support surface 500 in the z-axis may be increased to thereby increase the available damping distance Dz (i.e. damping resistance available for absorbing recoil movement) in the z-axis to absorb recoil force Fr from the firing of a projectile 340 from the gun barrel 300.

As the angle of the barrel axis 302 relative to the x-axis is decreased, the maximum recoil damping distance Dz_max of the chassis 200 from the support surface 500 in the z-axis for that gun firing condition may be decreased, and the distance Dy of the first wheel 404 from the x-axis in a direction along the y-axis is increased. This increases the stability of the chassis 200 along the x-axis and γ-axis to maintain orientation of the chassis 200 when recoil is generated in response to recoil force Fr from the firing of a projectile 340 from the gun barrel 300.

The self-propelled gun system 10 may further comprise an actuator operable to adjust the maximum recoil damping distance Dz_max of the chassis 200 from the support surface 500 in a z-axis in response to an input from a user.

The chassis suspension system 400 may also be configured to position the chassis 200 at a preferred height above the support substrate 500 for transit, for example when the self-propelled vehicle is travelling from one location to another over land. The height of the chassis 200 above the ground when in transit mode may be within the range of values of maximum recoil damping distance Dz_max. Alternatively the height of the chassis 200 above the ground when in transit mode may be greater than or less than the range of values of maximum recoil damping distance Dz_max.

Hence while the chassis suspension system 400 may also be used to provide normal suspension function when the vehicle is in transit, it also provides a recoil mitigation function, as will be described.

The resilient suspension unit 420 may comprise at least one of air springs, switchable shock absorbers, hydropneumatic, hydrolastic, and hydragas suspensions. The resilient suspension unit 420 may be configured to vary its spring stiffness. The resilient suspension unit 420 may be configured to vary its damping stiffness.

The gun barrel 300 may be constrained to pivot about the pivot axis 310 aligned with the y-axis in a plane of movement extending through the x-axis and z-axis. For example, the gun barrel 300 may be pivotably mounted using a trunnion mount.

The gun barrel 300 is constrained to pivot about the pivot axis 310 between 5 degrees below the x-axis and 75 degrees above the x-axis. That is to say, the gun barrel 300 is constrained to pivot about the pivot axis 310 between −5 degrees relative to the x-axis (i.e. pointing downwards) and +75 degrees relative to the x-axis (i.e. pointing upwards).

Alternatively or additionally, the gun barrel 300 is rotatable about the z-axis, limited (i.e. constrained) to be rotatable no more than +/−5 degrees from alignment with x-axis around the z-axis. For example, where present, the trunnion mount may be rotatably mounted to rotate about the z-axis.

When the angle of the barrel axis 302 relative to the x-axis is decreased (for example, moving from the position in FIG. 2 to the position in FIG. 1), the maximum recoil damping distance Dz_max (i.e. height) of the chassis 200 from the support surface 500 in the z-axis for that gun firing condition may be decreased (for example, moving from the position in FIG. 5 to the position in FIG. 7).

At the same time, and as illustrated in in FIGS. 5 to 7, the distance Dy of the first wheel 404 from the x-axis in a direction along the y-axis is increased from Dy1 in FIG. 5 to Dy3 in FIG. 7 to thereby increase the stability of the chassis 200 along the x-axis and γ-axis and thereby maintain orientation of the chassis 200 in response to recoil force Fr from the firing of a projectile 340 from the gun barrel 300.

Hence as the angle of the barrel axis 302 relative to the x-axis is decreased (for example, moving from the position in FIG. 2 to the position in FIG. 1), the distance Dy of the first wheel 404 from the x-axis in a direction along the y-axis is increased from Dy1 in FIG. 5 to Dy3 in FIG. 7.

Hence as barrel axis 302 moves towards the horizontal (i.e. parallel to the x-axis), the chassis 200 may be brought closer to the ground 500. This is beneficial since, as the barrel axis 302 moves towards the horizontal, the reaction to recoil in response to recoil force Fr from the firing of a projectile 340 from the gun barrel 300 will cause the chassis 200 to move along the substrate 500, and hence the extra width provided by the extended wheel arms from Dy1 to Dy2 or Dy3 provides stability.

Figure 8:
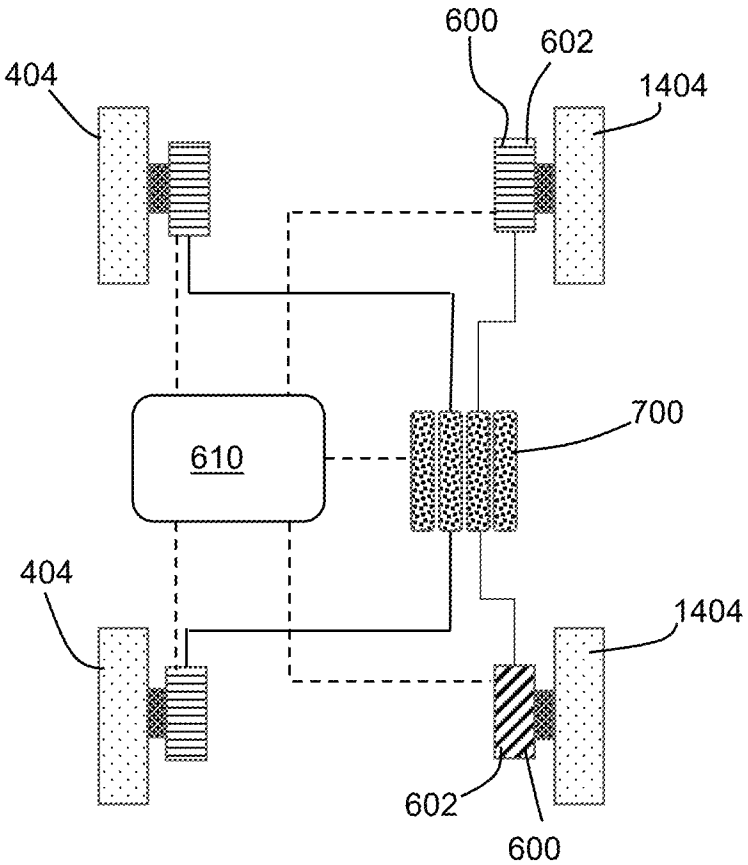
FIG. 8 illustrates a regenerative braking system which forms part of the recoil mitigation system of the present disclosure.
Figure 9:
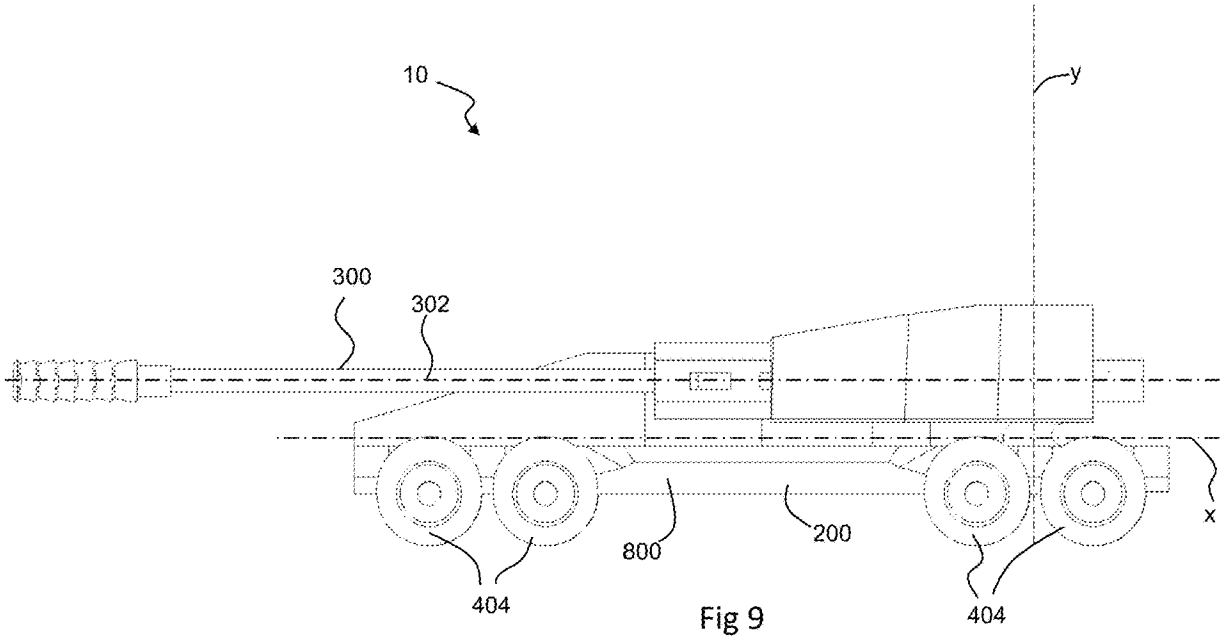
FIG. 9, 10 illustrate a side view of an example of a self-propelled gun system according to the present disclosure.

As shown in FIG. 8, the self-propelled gun system 10 may further comprise a wheel brake control device 600 configured for applying a braking force to the wheels 404, 1404 in response to movement of the chassis 200 in the x-axis by a recoil force Fr from the firing of a projectile 340 from the gun barrel 300.

The brake control device 600 is configured for applying the braking force to the rotatable wheel 404, 1404 after the firing of a projectile 340 from the gun barrel 300 and after the rotatable wheel 404, 1404 has started rotating (e.g. moving/spinning) along the support surface 500 in response the firing of a projectile 340 from the gun barrel 300.

The brake control device 600 is configured to gradually and/or intermittently apply the braking force to the respective rotatable wheel 404, 1404 after the wheel 404, 1404 has started rotating. This arrangement is operable to prevent wheel skid.

The brake control device 600 may be a regenerative braking device 602, and the regenerative braking device 602 may be operably linked with a rechargeable electric storage device 700 and the at least one first wheel 404 for generating an electrical current by decelerating the at least one first wheel (404) and dissipating the recoil of the self-propelled gun system 10.

As shown in FIG. 8, the brake control device 600 may be a regenerative braking device 602 or friction braking device 604.

The regenerative braking device 602 may be operably linked with a rechargeable electric storage device (e.g. battery) 700 and the at least one wheel 404 for generating an electrical current by decelerating the at least one wheel 404 and dissipating the recoil of the self-propelled gun system 10.

Electrical power generated by the regenerative braking device 602 may be stored by the battery 700.

The self-propelled gun system 10 may further comprise a processor 610 in communication with the regenerative braking device 602 and to the rechargeable electric storage device 700 such that in response to a first movement of the chassis 200 in the x axis, the processor 610 causes the regenerative braking device 602 to act on (e.g. decelerate) the first wheel 404. In examples in which other wheels 404, 1404 are provided, the processor 610 may be operable to cause the regenerative braking device 602 to act on (e.g. decelerate) one or more of the other wheels on the gun system.

Figure 3:
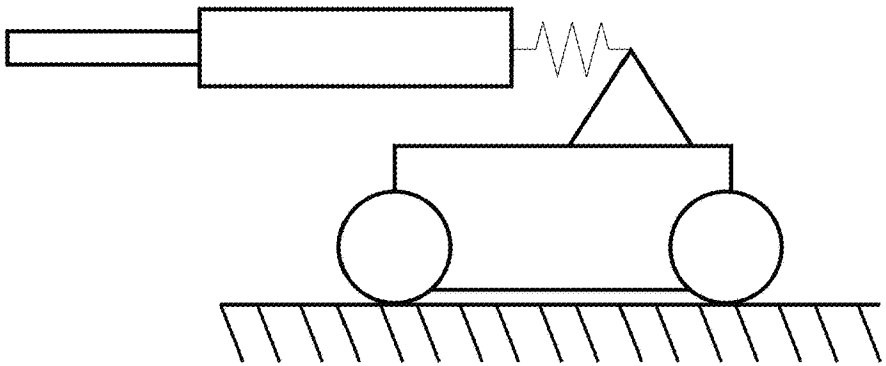

Hence the platform/chassis 200 is supported on wheels 404, 1404 via a suspension system 400. As illustrated in FIG. 3, when the gun barrel 300 is horizontal, the horizontal component of recoil forces are absorbed by braking the wheels 404, 1404 i.e. allowing platform to start to travel during recoil (hence with no brake applied, and hence with no braking force applied), and then engaging brake 600, of whatever kind, when recoil finished (i.e. after firing of the projectile). However the suspension 400 plays almost no part in mitigating recoil in this configuration (hence no suspension is shown in this figure).

Figure 4:
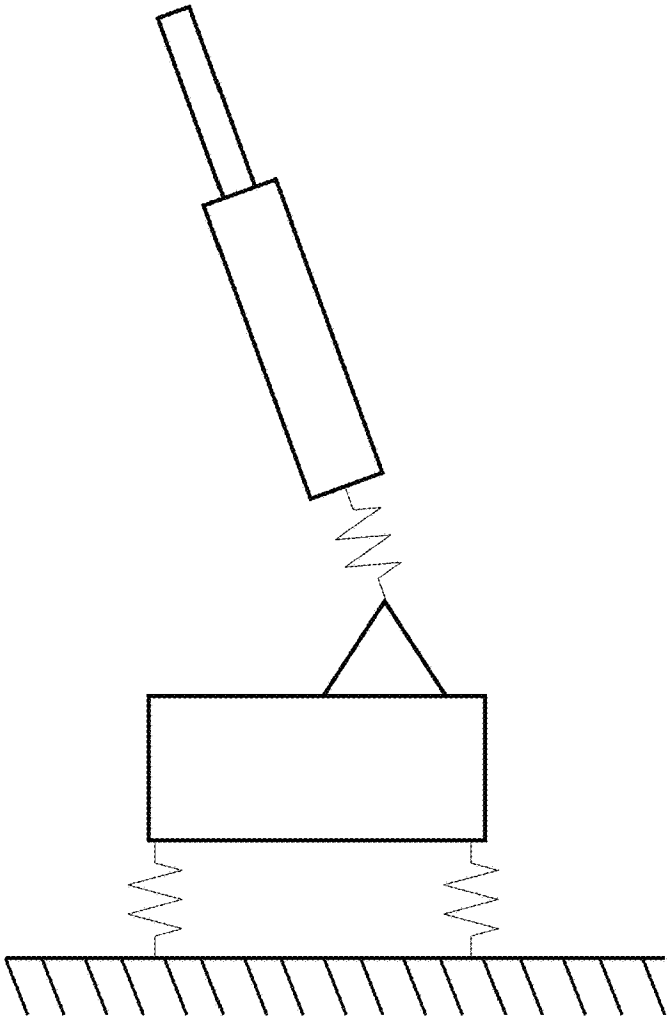
FIGS. 3, 4 illustrate diagrammatically the primary means of recoil mitigation for the configurations shown in FIGS. 1, 2.

As illustrated in FIG. 4, vertical component of recoil forces are absorbed by suspension 400, which may be jacked up higher to produce a greater distance of travel to provide damping when the angle of the barrel 300 relative to horizontal is increased. However the brake device 600 plays almost no part in mitigating recoil in this configuration (hence no wheels 404, 1404 are shown).

In positions intermediate between that shown in FIG. 3 (barrel 300 horizontal) and FIG. 4 (barrel nearly vertical) both the wheels 404, 1404 and suspension system play a part in recoil mitigation.

The apparatus of the present invention may be operated according to a method such that, for each gun firing condition the first wheel arm 402 and/or second wheel arm 1402 are pivoted relative to the chassis 200 to change the distance of the chassis 200 from the support surface 500 in the z-axis to the set maximum recoil damping distance Dz_max (e.g. distance of travel to provide damping) for the gun firing condition.

The wheel 404, 1404 brake control device 600 is configured for applying a braking force to the rotatable wheel 404, 1404 in response to movement of the chassis 200 in the x-axis by a recoil force (Fr) from the firing of a projectile 340 from the gun barrel 300. The brake control device 600 is controlled to apply the braking force to the rotatable first wheel 404 after the firing of a projectile 340 from the gun barrel 300. That is to say, when the projectile is fired, the wheels 404, 1404 are free to rotate/move. Only after the firing of the projectile is braking force applied.

The set maximum recoil damping distance Dz_max of the chassis 200 from the support surface 500 for the gun firing position may be varied to accommodate varying recoil force directions due to the angle of the barrel 300 relative to x-axis according to a predetermined relationship.

The predetermined relationship may be a function of: a mass of a projectile 340 being fired from the gun barrel 300, the type and mass of charge provided to propel the projectile 340 and/or angle of the barrel axis 302 relative to the x-axis.

The predetermined relationship may be a function of: expected recoil force and/or angle of the barrel axis 302 relative to the x-axis.

At low angle firing gun conditions the entire vehicle is allowed to roll backwards under free recoil. Once the vehicle is moving its movement is then arrested by applying brakes on the wheels 404, 1404. The extra stability provided by moving the wheels 404, 1404 outwards reduced the risk of the vehicle tipping.

At high angle firing gun conditions, the chassis suspension system 400 is used to absorb the force, the suspension 400 having been adjusted to increase damping distance and/or to increase damping resistance to add available recoil stroke. At high angle firing conditions, it is less likely the vehicle will tip, and the extra damping distance and/or damping resistance provided by the chassis suspension system is needed to stop the chassis 200 from contacting the support surface 500.

At intermediate angles the suspension 400 may be adjusted to a suitable intermediate height, optimized to counter the vertical and horizontal elements of the shot load using the suspension 400 and free recoil of the platform.

The free recoil can only be achieved if there is little to no traverse at the cannon/elevating mass so that recoil is always straight back through the wheels/tracks, thereby allowing them to roll. This requires all/most of the gun traversing to be done at a whole platform level by using steering/the wheels and/or suspension adjustments.

Selection will be a continual transition between the extreme positions so that the resolved vectors (vertical and horizontal) can be appropriately handled.

Hence there is provided a self-propelled gun system which is relatively lightweight and yet stable, with a suspension system configured for transit and gun operation. The reduction in weight is achievable, in part, by combining the suspension system for transit as well as restricting the amount the barrel can pivot about the y-axis and/or z-axis.

Hence this solution adds both effective recoil stroke length and recoil system mass without adding any extra weight to the platform and will allow for effective recoil management on lighter systems.

That the vehicle is operable to accelerate into "free recoil" more or less unimpeded (i.e. no or low braking forces during acceleration phase) before subsequently being brought to rest by damping systems/brakes, minimises forces on the vehicle, thus extending its operational life.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A self-propelled gun system, comprising:

a chassis extending along an x-axis, a first end of the chassis and a second end of the chassis spaced apart from one another along the x-axis, the chassis extending along a y-axis, a first side of the chassis and a second side of the chassis spaced apart from one another along the y-axis, the x-axis being at right angles to the y-axis;

a gun barrel having a barrel axis, the barrel being mounted to the chassis by a pivot mount, the barrel being pivotable relative to the x-axis about a pivot axis aligned and/or parallel with the y-axis;

a chassis suspension system comprising a wheel arm extending away from the chassis to a wheel, the wheel being rotatably mounted on the wheel arm, the wheel configured for engagement with a support surface, the wheel arm and wheel configured to support the chassis a distance (Dz) apart from the support surface in a z-axis, the z-axis being perpendicular to the x-axis and y-axis;

a recoil mitigation system operable such that a maximum recoil damping distance (Dz_max) of the chassis from the support surface in the z-axis is variable to thereby vary the available damping distance in the z-axis to absorb recoil force (Fr) from the firing of a projectile from the gun barrel; and a brake control device configured for applying a braking force to the wheel in response to movement of the chassis in the x-axis by a recoil force (Fr) from the firing of a projectile from the gun barrel, wherein the brake control device is configured for applying the braking force to the wheel after the firing of a projectile from the gun barrel and after the wheel has started rotating along the support surface in response to the firing of a projectile from the gun barrel, and wherein the brake control device is configured to gradually and/or intermittently apply the braking force to the wheel after the wheel has started rotating.

2. The self-propelled gun system of claim 1, wherein the brake control device is a regenerative braking device, and the regenerative braking device is operably linked with a rechargeable electric storage device and the wheel for generating an electrical current by decelerating the wheel and dissipating recoil of the self-propelled gun system.

3. The self-propelled gun system of claim 2, further comprising a processor in communication with the regenerative braking device and the rechargeable electric storage device such that in response to a movement of the chassis along the support surface, the processor causes the regenerative braking device to decelerate the wheel.

4. The self-propelled gun system of claim 1, wherein the gun barrel is constrained to pivot about the pivot axis in a plane of movement extending through the x-axis and z-axis and/or is constrained to pivot about the pivot axis between −5 degrees to the x-axis and +75 degrees to the x-axis.

5. The self-propelled gun system of claim 1, wherein the gun barrel is rotatable about the z-axis, limited to be rotatable no more than +/−5 degrees relative to a direction parallel to the x-axis around the z-axis.

6. The self-propelled gun system of claim 1, wherein a distance (Dy) of the wheel from the x-axis in a direction along the y-axis is operable to be increased to thereby increase the stability of the chassis along the x-axis and y-axis to maintain orientation of the chassis during and after the firing of a projectile from the gun barrel.

7. The self-propelled gun system claim 1, wherein the maximum recoil damping distance (Dz_max) of the chassis from the support surface in the z-axis for a gun firing condition is controlled to be set by pivoting the wheel arm relative to the z-axis, and the self-propelled gun system comprises:

a resilient suspension unit to bias the wheel arm to move the chassis back to being spaced apart from the support surface by the maximum recoil damping distance (Dz_max) after displacement of the chassis away from the maximum recoil damping distance (Dz_max).

8. The self-propelled gun system of claim 7, wherein the wheel arm extends away from the chassis at an angle to the x-axis and the y-axis, and the resilient suspension unit extends between the chassis and the wheel arm.

9. The self-propelled gun system of claim 7, wherein the resilient suspension unit comprises at least one of air springs, switchable shock absorbers, hydropneumatic suspension, hydrolastic suspension, and hydragas suspension, wherein the resilient suspension unit is configured to vary its spring stiffness.

10. The self-propelled gun system of claim 1, wherein the chassis suspension system further comprises a leg strut, the leg strut pivotably attached to the chassis at a coupling end, and extending to a foot configured for engagement with the support surface to support the chassis apart from the support surface.

11. The self-propelled gun system claim 1, wherein the unladen mass of the self-propelled gun system is no greater than 10 tonnes.

12. The self-propelled gun system claim 1, wherein the unladen mass of the self-propelled gun system is no greater than 5 tonnes.

13. A method of operation of a self-propelled gun system, the self-propelled gun system including a chassis extending along an x-axis, a first end of the chassis and a second end of the chassis spaced apart from one another along the x-axis, chassis extending along a y-axis, a first side of the chassis and a second side of the chassis spaced apart from one another along the y-axis, the x-axis being at right angles to the y-axis, a chassis suspension system comprising a wheel arm extending away from the chassis to a wheel, the wheel being rotatably mounted on the wheel arm, the wheel configured for engagement with a support surface, the wheel arm and wheel configured to support the chassis a distance (Dz) apart from the support surface in a z-axis, the z-axis being perpendicular to the x-axis and y-axis, the wheel arm being pivotable relative to the chassis, a resilient suspension unit to bias the wheel arm to move the chassis back to being spaced apart from the support surface by a set maximum recoil damping distance (Dz_max) after displacement of the chassis away from the set maximum recoil damping distance (Dz_max), and a brake control device configured for applying a braking force to the wheel in response to movement of the chassis in the x-axis by a recoil force (Fr) from the firing of a projectile from the gun barrel; and the method comprising, for each gun firing condition:

pivoting the wheel arm relative to the chassis to change the distance of the chassis from the support surface in the z-axis to the set maximum recoil damping distance (Dz_max) for the gun firing condition;

wherein the set maximum recoil damping distance (Dz_max) of the chassis from the support surface for the gun firing position is set according to a predetermined relationship; and the brake control device is controlled to apply the braking force to the wheel after the firing of a projectile from the gun barrel.

14. The method of claim 13, wherein the predetermined relationship is a function of:

a mass of a projectile being fired from the gun barrel;

the type and mass of charge provided to propel the projectile; and/or angle of the barrel axis relative to the x-axis.

15. A gun system, comprising:

a chassis;

a gun barrel;

a chassis suspension system comprising a wheel arm extending away from the chassis to a wheel, the wheel being rotatably mounted on the wheel arm, the wheel configured for engagement with a support surface, the wheel arm and wheel configured to support the chassis a distance (Dz) apart from the support surface;

a recoil mitigation system operable such that a maximum recoil damping distance (Dz_max) of the chassis from the support surface is variable to thereby vary the available damping distance in a first direction to absorb recoil force from the firing of a projectile from the gun barrel; and a brake control device configured for applying a braking force to the wheel in response to movement of the chassis in in a second direction by a recoil force from the firing of a projectile from the gun barrel, wherein the brake control device is configured to gradually and/or intermittently apply the braking force to the wheel after the wheel has started rotating along the support surface in response to the firing of a projectile from the gun barrel.

16. The gun system of claim 15, wherein the brake control device is configured for applying the braking force to the wheel after the firing of the projectile from the gun barrel.

17. The gun system of claim 15, wherein the brake control device is a regenerative braking device for generating an electrical current by decelerating the wheel and dissipating recoil of the gun system, the gun system further comprising a processor in communication with the regenerative braking device such that in response to a movement of the chassis along the support surface, the processor causes the regenerative braking device to decelerate the wheel.

* * * * *